United States Patent [19]

Evans

[11] Patent Number: 4,540,172

[45] Date of Patent: Sep. 10, 1985

[54] FRICTION TYPE EXERCISING DEVICE

[75] Inventor: Harold R. Evans, Jersey, Channel Islands

[73] Assignee: Tekron Licensing B.V., De Leersum, Netherlands

[21] Appl. No.: 230,514

[22] Filed: Feb. 2, 1981

Related U.S. Application Data

[63] Continuation of Ser. No. 861,415, Dec. 16, 1977, abandoned.

[30] Foreign Application Priority Data

Dec. 18, 1976 [GB] United Kingdom ..... 52985/76

[51] Int. Cl.[3] ..... A63B 21/00

[52] U.S. Cl. ..... 272/133

[58] Field of Search ..... 272/133, 132, 131, 134, 272/DIG. 3, 144, 70, 130, 125, 126; 434/255

[56] References Cited

U.S. PATENT DOCUMENTS

| | | | |
|---|---|---|---|
| 1,909,190 | 5/1933 | Sachs | 272/70 |
| 2,772,881 | 12/1956 | Fundom . | |
| 3,550,449 | 12/1970 | Henson | 272/133 |
| 3,717,339 | 2/1973 | Holkesvick et al. . | |
| 3,970,302 | 7/1976 | McFee | 272/130 |

FOREIGN PATENT DOCUMENTS

| | | | |
|---|---|---|---|
| 523174 | 4/1931 | Fed. Rep. of Germany | 272/70 |
| 574743 | 4/1976 | Switzerland | 272/70 |
| 389682 | 3/1933 | United Kingdom | 272/131 |

*Primary Examiner*—Richard J. Apley
*Assistant Examiner*—William R. Browne
*Attorney, Agent, or Firm*—Brumbaugh, Graves, Donohue & Raymond

[57] ABSTRACT

An exercising machine includes a pair of inclined guide tracks on each of which a foot-supporting member is arranged to slide frictionally, and the foot-supporting members are interconnected by an elongate flexible tension-bearing element, specifically a flat strap, which slides frictionally over stationary guides.

8 Claims, 12 Drawing Figures

FRICTION TYPE EXERCISING DEVICE

This is a continuation of application Ser. No. 861,415 filed Dec. 16, 1977, now abandoned.

BACKGROUND OF THE INVENTION

1. Field of the Invention

This invention relates to exercising equipment, and more particularly to exercising equipment which is so arranged that the user of the equipment can perform exercises simulating the climbing of a flight of stairs.

2. Description of the Prior Art

One form of exercising equipment is disclosed in German Pat. No. 523,174, and comprises a pair of foot-supporting members which can slide along a pair of inclined tracks. The foot-supporting members are linked by a rope which passes over a V-grooved pulley, so that downward movement of one foot-supporting member is accompanied by rotation of the pulley, and by upwards movement of the other foot-supporting member. In operation, the user of the equipment stands with one foot on each of the foot-supporting members, and transfers his weight alternately on to one foot and then on to the other, so that the foot-supporting members move up and down in antiphase, and the user has to lift his body weight each time he transfers it from one foot-supporting member to the other; in this way, the climbing of a flight of stairs is simulated. An adjustable brake is provided to retard the rotation of the V-grooved pulley, so that the downward movement of whichever foot-supporting member carries the user's weight is braked, and the work done by the user in lifting his body weight is dissipated as heat in the brake. A releasable latch is also provided, to prevent rotation of the V-grooved pulley until the user has lifted his body weight through the full difference in height between the foot-supporting members.

With this previously-disclosed form of exercising equipment, the frictional resistance opposing rotation of the pulley is primarily dependent on the setting of the brake, so that the brake has to be adjusted to match the frictional resistance to the weight of different users. Also, this previously-disclosed form of exercising equipment has a number of moving parts, of which at least the pulley has to be rotatably mounted on bearings, which may need attention such as lubrication. The presence of these moving parts contributes to the complexity and cost of the equipment.

Another form of exercising equipment is disclosed in U.S. Pat. No. 3,970,302, and comprises a pair of foot-supporting members, each of which can move up and down an inclined track. The foot-supporting members are linked by a cable which is guided around a number of pulleys, so that the foot-supporting members move in anti-phase; the cable is also connected to a rocking lever, whose movement is damped by a pair of telescopic hydraulic shock absorbers. The shock absorbers retard the downward movement of whichever foot-supporting member carries the user's weight, and thus absorb the work done by the user.

This form of exercising equipment develops a force in opposition to the movement of the foot-supporting members which is, at least approximately, proportional to the speed of this movement, and which can also be adjusted by adjusting the point of connection of the shock absorbers to the rocking lever. Thus, with this form of equipment also, it is necessary to adjust the equipment to match users of different weights, since if no such adjustment were made, the speed of the foot-supporting members would increase in proportion to increases in the body weight of the user. Also, this form of exercising equipment has a considerable number of moving parts associated with the damping mechanism, and these parts may periodically require lubrication. The moving parts also increase the complexity and cost of the equipment; in particular, the use of hydraulic shock absorbers is a comparatively expensive way of providing energy adsorption, and also introduces the possibility of oil spillage.

It is an object of the present invention to provide exercising equipment of the type which allows the climbing of stairs to be simulated, which does not require adjustment to allow it to be used by users of different weights, has a minimum number of moving parts, does not require lubrication, and employs a simple arrangement for dissipating as heat the work done by the user.

DESCRIPTION OF THE INVENTION

According to one of the principal aspects of the invention, exercising equipment comprises a track system, means for supporting the track system with one end higher than the other, two foot-supporting members guided on the track system for movement therealong, and an elongate flexible tension-bearing element which extends in a path in the course of which it is deflected around guiding means, and the tension-bearing element being arranged to have tension loads applied to different parts thereof by downward loads on the foot-supporting members, the arrangement being such that, if a user of the equipment applies a sufficiently greater portion of his weight to one of the foot-supporting members than to the other that the said one foot-supporting member moves downwards along the track system, then the other foot-supporting member is moved up the track system by the tension-bearing element, and the tension-bearing element is thereby forced to slide frictionally around at least one part of the guiding means.

The frictional sliding of the tension-bearing element around the guiding means may provide sufficient resistance to the movement of the foot-supporting members along the track system, so that no extra moving parts need be provided to absorb the work done by the user. The magnitude of this frictional resistance is, at least approximately, proportional to the tension in the tension-bearing element, and therefore to the weight of the user, so that the resistance against which the user has to work is automatically adjusted to match the weight of the user. The guiding means need not include any rotatable parts, so that the need for lubrication of the arrangement which controls the movements of the foot-supporting members can be entirely eliminated.

The foot-supporting members may be arranged to slide frictionally along the tracks of the track system. Friction pads may be provided on each foot-supporting member, to rub along the tracks and ensure smooth, quiet operation. For example, the friction pads may be of a textile material such as nylon webbing. With this arrangement, it is possible to devise exercising equipment in which the only moving parts are the two foot-supporting members, and the elongate tension-bearing element, none of which require lubrication.

The said part of the guiding means may comprise a component of cylindrical or part-cylindrical shape, which is arranged to be unable to rotate. (It should be understood that the term 'cylindrical' embraces shapes other than circular cylinders, such as, for example, elliptical cylinders.) In a preferred arrangement the said part is a stationary component but it is also possible for the elongate tension-bearing element to slide frictionally around a non-rotatable component which is attached to move with one of the foot-supporting members. In this case, downward loads on the foot-supporting members could be transferred to the tension-bearing element solely by the contact forces in the area where frictional sliding occurs.

According to another aspect of the invention, exercising equipment comprises a track system, means for supporting the track system with one end higher than the other, two foot-supporting members guided on the track system for movement therealong, and an elongate flexible tension-bearing element which extends upwards from one foot-supporting member, in a direction generally parallel to the direction of movement of the said one foot-supporting member, and is then deflected, around guiding means, to extend downwards to the other foot-supporting member, in a direction generally parallel to the direction of movement of the said other foot-supporting member, the tension-bearing element being wrapped around at least a part of the guiding means in a generally helical path. The equipment may be so arranged that the flexible tension-bearing element can slide frictionally along the said generally helical path. In a preferred arrangement, the guiding means comprises two stationary members having at least part-cylindrical surfaces, which members are arranged obliquely at the top of the track system, with the generatrices of their said surfaces converging in the upward direction, and the tension-bearing element extends upwards from one foot-supporting member, in a helical path around one of the stationary members, transversely of the track system to the other stationary member, in a helical path thereabout, and thence downwardly to the other foot-supporting member. This arrangement is particularly convenient where the tension-bearing element is a flat strap, and the two parts of the strap which are attached to the foot-supporting members lie at least approximately in the same plane, since the helical wrap of the strap around the stationary members serves to turn the strap into the direction transverse of the track system. The helical wrap of the strap may also be utilised to shift the transversely-extending part of the strap out of the plane of the track system, so that it will clear stationary parts of the track system. However, other arrangements are possible with other aspects of the invention; for example, if a flat strap is used, but is arranged with its width generally at right angles to the plane which contains the lines of action of the tensions exerted by the strap on the foot-supporting members; in particular, it is possible to deflect the tension-bearing element without the need for it to wrap helically around any part of the guiding means. The guiding means may then comprise one or more members having at least partially cylindrical surfaces, with the generatrices of these surfaces extending parallel to the width of the strap.

In a further generally similar embodiment, a similar arrangement of the guiding means is used, but the elongate tension-bearing element is wrapped helically around the cylindrical members, so that its transversely-extending part is shifted out of the plane of the track system.

According to another aspect of the invention, exercising equipment comprises a track system, means for supporting the track system with one end higher than the other, two foot-supporting members guided on the track system for movement therealong, and an elongate flexible tension-bearing element which extends upwards from one foot-supporting member, in a direction generally parallel to the direction of movement of the said one foot-supporting member, and is then deflected around guiding means to extend downwards to the other foot-supporting member, in a direction generally parallel to the direction of movement of the said other foot-supporting member, the tension-bearing element being formed by a flat strap. The track system may afford, for each foot-supporting member, a pair of slideways which lie one on each side of the foot-supporting member.

The supporting means may support the track system in an inclined position. For example, the track system may be inclined at about the same angle as a typical flight of stairs, although other angles are possible. The equipment could include an adjustable stop, to allow it to be supported at different angles.

According to another aspect of the present invention, exercising equipment comprises a pair of guide tracks each having two parallel slideways, means for supporting the guide tracks with one end higher than the other, with the two slideways of each track side by side, two foot-supporting members, each of which has two slide portions, which can slide frictionally along the two slideways of a respective one of the guide tracks, and each of which has a foot-supporting portion which lies between the said two slideways, at least when seen in plan view, and the equipment also comprises means interconnecting the two foot-supporting members in such a way that, as one member is moved in a downward direction, the other moves in an upward direction.

According to another aspect of the present invention, exercising equipment comprises a pair of guide tracks, means for supporting the guide tracks with one end higher than the other, two foot-supporting members each having one or more friction pads by which it is supported on a corresponding one of the guide tracks, for sliding frictionally along the track, and means interconnecting the two foot-supporting members in such a way that, as one member is moved downwards along its track, the other moves upwards along its track.

With such equipment, the frictional sliding of the foot-supporting members along the tracks produces a frictional resistance to movement of the foot-supporting members by the user of the equipment. This resistance may be additional to the frictional resistance which is produced by frictional sliding of the tension-bearing element, in earlier aspects of the invention.

The foot-supporting portion of each foot-supporting member may be formed by a horizontal platform, although it may alternatively take the form of a rung. Particularly where a horizontal platform is used, it may be desirable to arrange that the foot-supporting portion has a storage position to which it can be moved, and in which it does not substantially increase the overall size of the track system. The means for supporting the tracks or track system may comprise a support frame which extends approximately vertically from an upper part of the tracks or track system to the ground, the guide tracks or track system and the support frame being collapsible to lie approximately in the same plane when the equipment is not in use. In this way, the equipment can be made to occupy only a small storage space. Where the support frame also affords a handhold at its upper end, the handhold may be arranged to collapse, for example by telescoping with the lower part of the support frame, to reduce the necessary storage space further.

DETAILED DESCRIPTION OF THE SPECIFIC EMBODIMENTS

Figure 1:
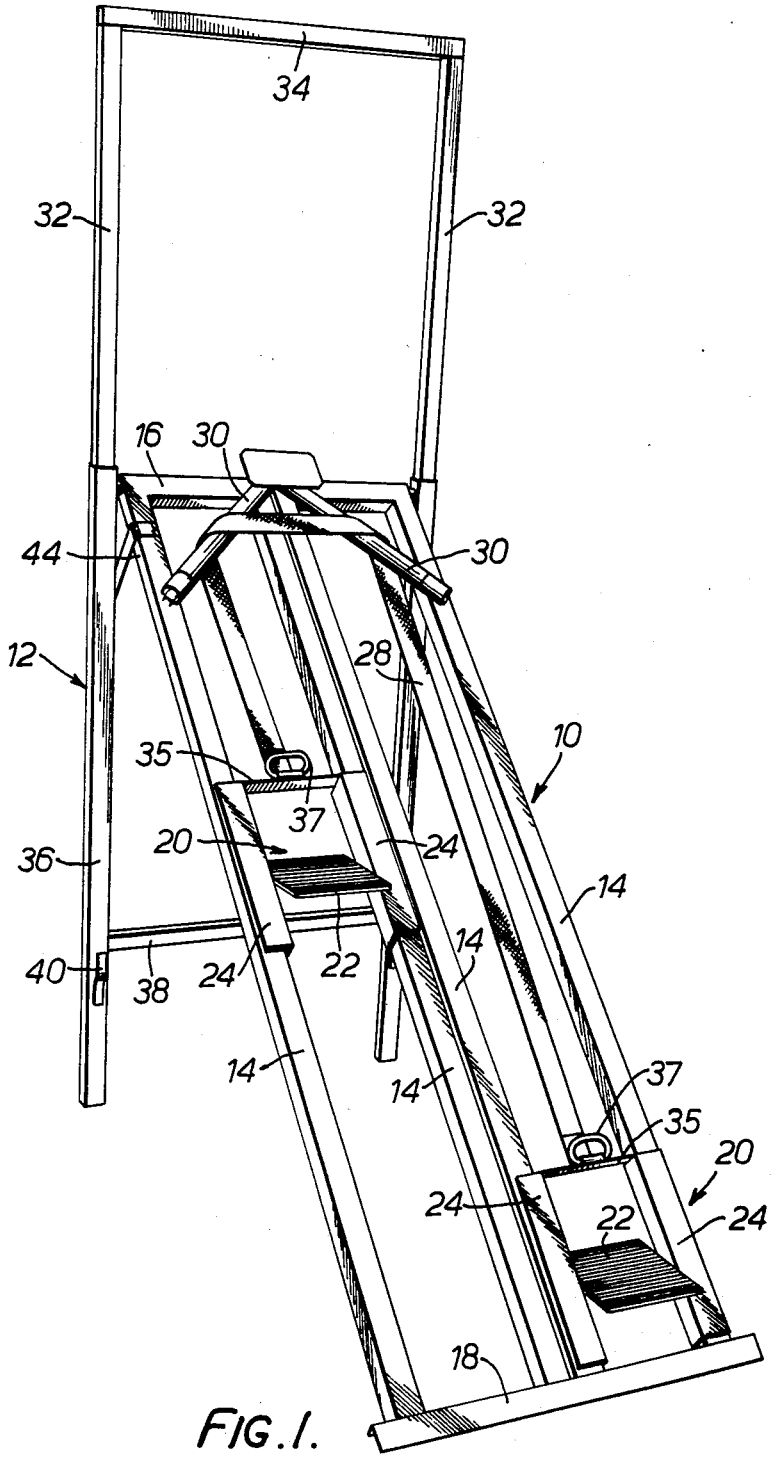
FIG. 1 is a perspective view of an exercising device embodying the invention, in its position ready for use.
Figure 2:
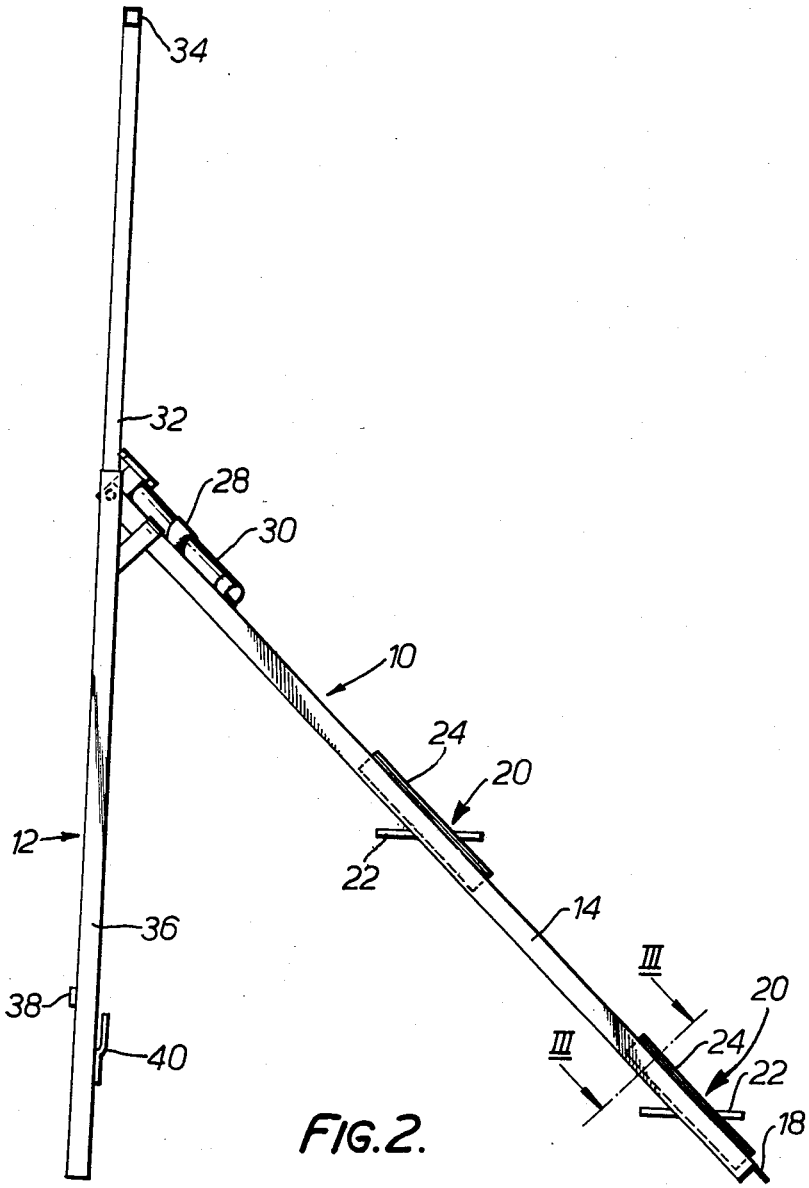
FIG. 2 is a side elevation of the exercising device in the position of FIG. 1.

As can be seen from FIGS. 1 and 2, the exercising device includes a track system 10 which, in the operating position, is inclined at about 40° to the horizontal, and a rear support frame 12 which supports the upper end of the track assembly 10. The track assembly comprises four parallel square section tubes 14 are interconnected at their top and bottom ends by cross-members 16 and 18, and which provide slideways for two foot-supporting steps 20. The steps 20 are interconnected by a flat strap 28 of nylon webbing, which has one end attached to each of the steps 20. In its path from one step to the other, the strap 28 wraps around two stationary cylindrical tubes 30 which are welded to the tubes 14 near the upper ends of the latter, at an angle of 45° to the length of the latter. Thus, the strap extends downwards to each of the steps 20 in a direction parallel to the tubes 14, having followed a helical path around each of the cylindrical tubes 30, and also extends horizontally from one tube 30 to the other.

In operation, the user of the exercising device stands with one foot on each of the steps 20, and transfers the major part of his body weight alternately on to one foot and then on to the other. The step on which the major part of the user's body weight is being borne will slide down the tubes 14, and, since the webbing strap 28 is more or less inextensible, the other step 20 is drawn up towards the top of the tubes 14. In this way, the user of the device makes alternating movements which are similar to those involved in climbing stairs. The length of the strap 28 is adjustable, so that the length of travel of the steps 20 can be adjusted to suit the user.

The rear support frame 12 has upward continuations 32 above its connections to the track assembly 10, and the continuations 32 support a transverse bar 34 which may be grasped by the user of the device while he is performing exercises.

Figure 3:
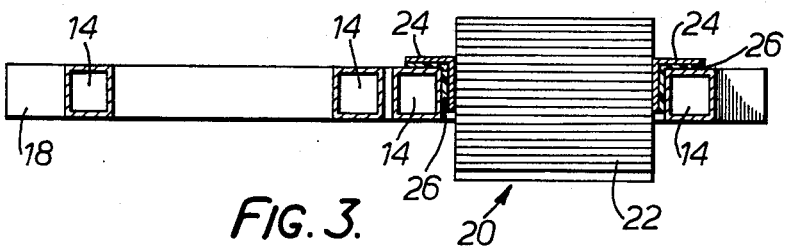
FIG. 3 is a section taken on the line III—III of FIG. 2.

Each step 20 comprises a platform-like tread 22 which is horizontal in the position shown in FIGS. 1 and 2, and has welded to its sides two L-section guides 24 which slide up and down the corresponding pair of tubes 14 when the exercising device is in use. The inner surfaces of the two limbs of each L-section, which engage against the top and side surfaces of the corresponding tube 14, are lined with nylon webbing 26 (see FIG. 3), to prevent metal-to-metal contact between the guides 24 and the tubes 14, in order to assist smooth, quiet operation of the device. The two guides 24 of each step are also connected, at their top ends, by a cross-bar 35 to which the webbing strap 28 is connected by means of a buckle 37, which allows adjustment.

In operation, friction occurs between the webbing 26 and the tubes 14, and between the strap 28 and the tubes 30, and this friction dissipates as heat the work being done by the user of the device. Obviously, this friction means that the load on whichever step 20 is travelling downwards is greater than the load on the other step; in a typical example, the amount of friction might be such that when, in normal usage, one step is moving upwards and the other is moving downwards, the load on the downward-moving step is about four times that on the upward-moving step. The relationship between the loads on the two steps 20 is dependent primarily on the coefficient of friction between the strap 28 and the tubes 30, the total angle of wrap of the strap about the tubes, and the helix angle of the path taken by the strap about the tubes. The ratio of the tension $T_1$ in the part of the strap 28 connected to the upward-moving step to the tension $T_2$ in the part of the strap connected to the downward-moving step is theoretically given by:

$$\frac{T_2}{T_2} = e^{\mu\theta \sin \alpha}$$

where $\mu$ is the coefficient of friction between the strap 28 and the tubes 30, $\theta$ is the total angle of wrap of the strap about the tubes ($2\pi$ radians in this case), and $\alpha$ is the helix angle of the helical path of the strap 28 (i.e. the angle between the path and a generator of the tube 30, which in this case is 45°).

The tubes 30 are provided with a hard, smooth surface for the webbing strap 28 to slide on; in this example, the surface is chromium plate.

Figure 4:
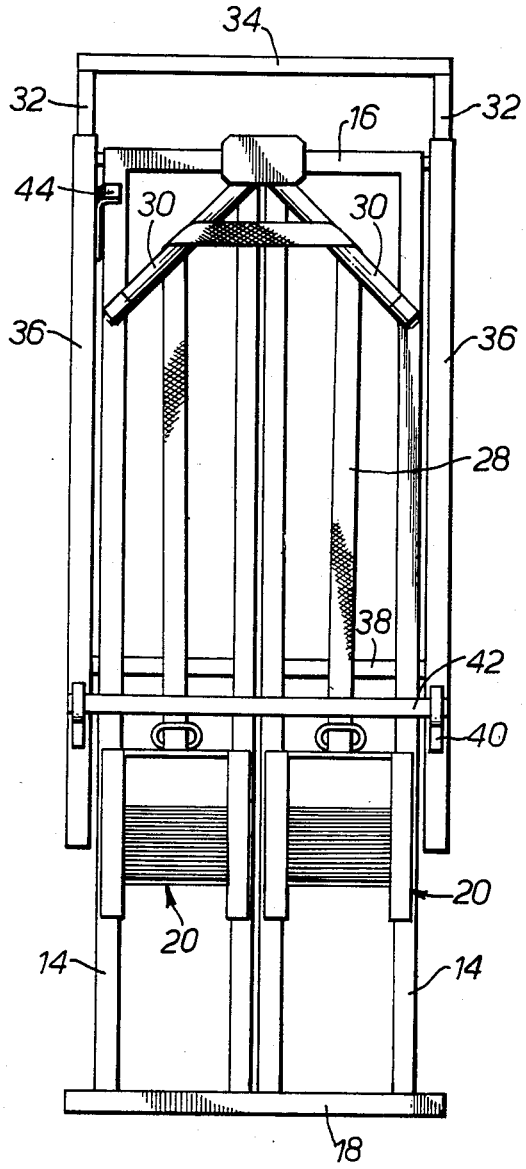
FIG. 4 is a front elevation of the device in a collapsed storage position.
Figure 5:
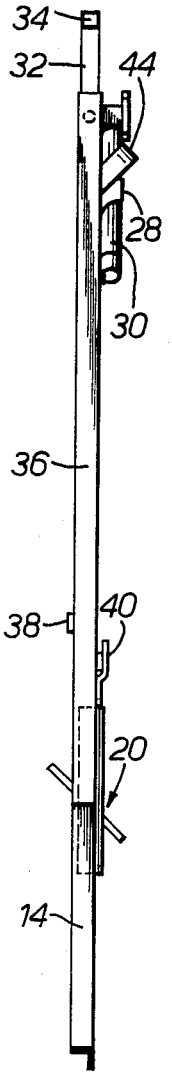
FIG. 5 is a side elevation of the device in the position of FIG. 4.

As FIGS. 4 and 5 show, the exercising device is collapsible for storage. The connection of the track assembly 10 at its upper end to the rear support frame 12 allows relative pivoting of these two items about a transverse horizontal axis, so that they can be brought together to lie in the same plane, as shown in FIG. 5. The rear support frame includes two legs 36 of square section tubing, which are connected near their lower ends by a cross-member 38 which is welded to the rear faces of the legs 36; thus, the cross-member 38 limits relative pivoting of the track assembly and the support frame beyond the position shown in FIG. 5. A hook 40 is welded to the front surface of each of the legs 36 near its bottom end; when the exercising device has been collapsed to its storage position, a separate cross-member 42 (FIG. 4) may be positioned in the hooks 40, to lie across the front of the track assembly 10, so that the device cannot move from its collapsed position. It will also be seen from FIG. 4 that, by positioning the steps 20 at the mid-point of their travel before dropping the cross-member 42 into the hooks 40, the cross-member 42 will also lie across the front of the lower parts of the strap 28, thereby helping to stop the steps 20 from swinging forwards away from the tubes 14.

When the exercising device is in the operating position, a stop 44 attached to one of the legs 36 near its pivotal connection to the track assembly 10 engages the top surface of one of the tubes 14 to prevent the track assembly and the rear support frame from splaying further apart.

The transverse bar or handle 34, and the upward continuations 32 of the rear support frame consist of square section tubing, and the continuations 32 can be telescoped into the legs 36 to reduce the size of the exercising device in the collapsed position, and also to adjust the height of the bar 34 to suit the height of the user.

Figure 6:
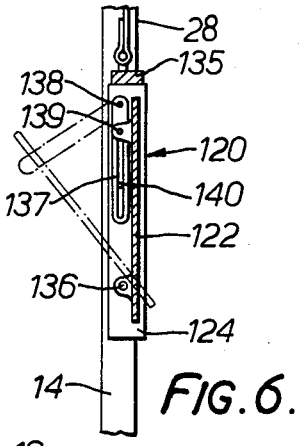
FIGS. 6 and 7 are longitudinal sections through two modified step constructions for the exercising device of FIGS. 1 to 5, shown with the device in a storage position.

FIG. 6 shows at 120 a modified form of step. This comprises two L-section guides 124 and a cross-bar 135, which are similar to the components 24 and 35 of FIGS. 1 to 5. The modified step also includes a pivot bar 136 which extends between the two guides 124, and on which a platform-like tread 122 is pivoted. Thus the tread 122 can pivot between its operating position, which is shown in broken line in FIG. 6, and in which the tread extends generally horizontally when the track system 10 is in its operating position, and a storage position, which is shown in full line in FIG. 6, and in which the tread 122 lies generally within the plane of the track system 10. A slotted stay 137 is pivoted at 138 to one of the guides 124, and receives in its slot a pin 139 connected to the tread 122; thus, in the operating position, the pin 139 abuts against the end of the slot, and prevents the tread 122 from pivoting under the user's weight. In the storage position, as illustrated, the slot of the stay 137 is sprung over a pin 140 mounted on the guide 124, to retain the tread 122 in the storage position.

Figure 7:
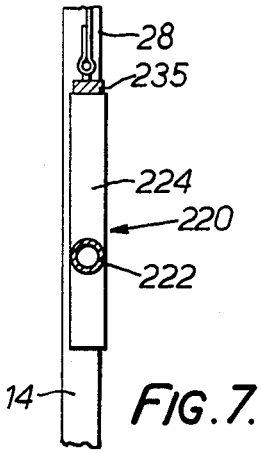

FIG. 7 shows, at 220, a further modified form of step. This comprises two L-section guides 224 and a cross-bar 235, which are similar to the components 24 and 35 of FIGS. 1 to 5. The modified step also includes a rung 222 of circular cross-section, which extends between the guides 224, and on which a user can place his foot.

Figure 8:
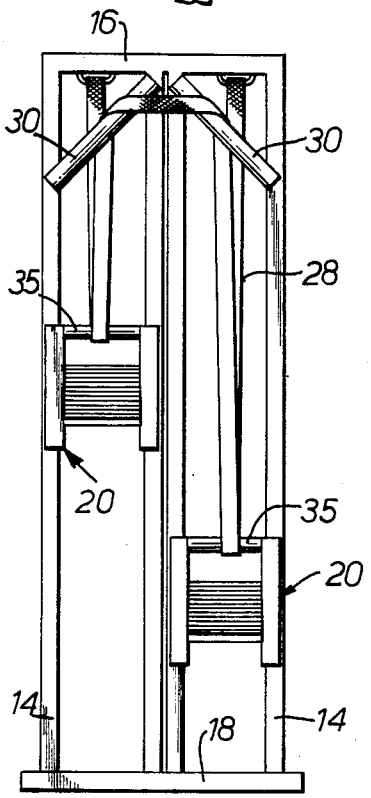
FIGS. 8 and 9 are views, similar to FIG. 4, but omitting a rear support frame, of two modified exercising devices.

FIG. 8 shows an alternative arrangement of the strap 28. Instead of the ends of the strap being anchored to the cross-bars 35, the strap passes under the cross-bars, which in this arrangement are of circular cross-section, and the ends of the strap are then secured to the upper cross-member 16 of the track system 10. Thus, in operation, the part of the strap 28 which extends from one cross-bar 35 to the other must travel twice as fast as the steps 20 when any movement of the steps occurs, with the strap sliding frictionally around the tubes 30 at this doubled speed, and also sliding frictionally around the cross-bars 35 at a speed equal to the speed of the steps 20. To a first approximation at least, the tension in the strap 28 is only half the strap tension which occurs in the arrangement of FIGS. 1 to 5, and therefore the friction forces on the tubes 30 are also halved, so that the energy absorbed by friction on the tubes 30 is approximately the same as in FIGS. 1 to 5. In addition to this energy absorption, friction where the strap 28 passes around the cross-bars 35 is also responsible for absorbing energy, so that the total amount of energy absorbed in this arrangement is greater than in FIGS. 1 to 5, for the same coefficient of friction.

Figure 9:
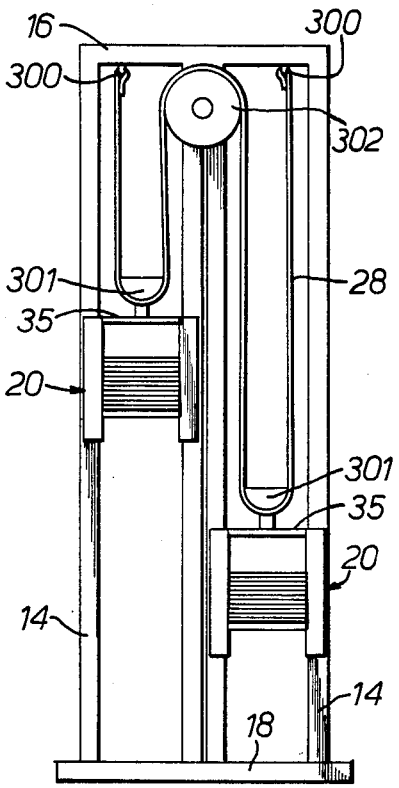

FIG. 9 shows a further alternative arrangement of the strap 28. In this arrangement, the strap is arranged with its width extending perpendicular to the general plane of the track system 10, so that the strap is seen edge-on in FIG. 9. The strap 28 extends downwards from an anchorage 300 on the upper cross-member 16 of the track system 10, passes around a D-shaped guide member 301 which is attached to the cross-bar 35 of one of the steps 20, and then passes upwards and around a freely-rotatable pulley 302. The strap then passes around a further D-shaped guide 301 on the other cross-bar 35, to a further anchorage 300 on the cross-member 16. Thus, in this arrangement, the strap 28 travels at twice the speed of the steps 20, as with the arrangement of FIG. 8, but the only frictional sliding of the strap occurs where it passes around the guide members 301.

It is to be understood that the edge-on arrangement of the strap 28 may be adopted, even in an arrangement which does not use the guides 301.

Figure 11:
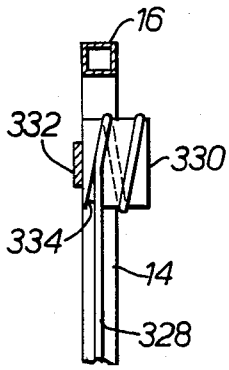
FIG. 11 is a section on the line XI—XI of FIG. 10.
Figure 10:
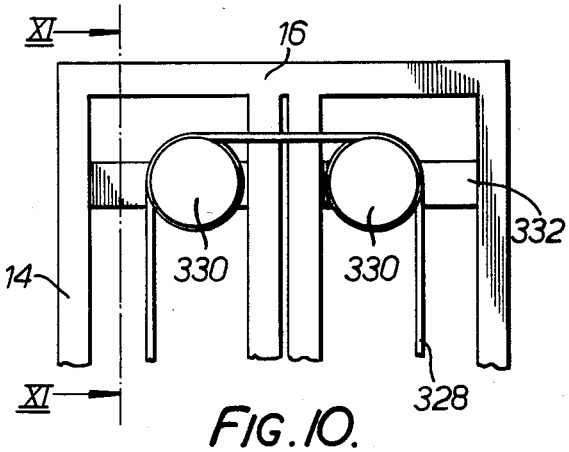
FIG. 10 is a view to an enlarged scale, corresponding to part of FIG. 4, of a further modified exercising device.

FIGS. 10 and 11 show another alternative arrangement, in which the flat nylon webbing strap is replaced by a round nylon cord 328. Instead of the obliquely-positioned tubes 30, two cylindrical guide members 330 are provided, which are mounted on a cross-member 332 which is attached to the rear of the tubes 14 of the track system 10. Each of the guide members 330 is provided with a helical groove 334, which guides the cord 328 in a helical path occupying $1\frac{1}{4}$ turns about the member 330. Because the path is helical, the cord 328 leaves the guide member 330 along a transverse path which is spaced away from the plane of the track system 10, although the parts of the cord which run parallel to the tubes 14 lie within the general plane of the track system. When the user of the equipment causes the steps (not shown) to rise and fall, the cord 328 slides frictionally around the guide members 330, dissipating energy as in the previous arrangements. The grooves 334 are made semi-circular in cross-section, to match the cross-section of the cord 328, so that the frictional contact takes place over an extended area.

Figure 12:
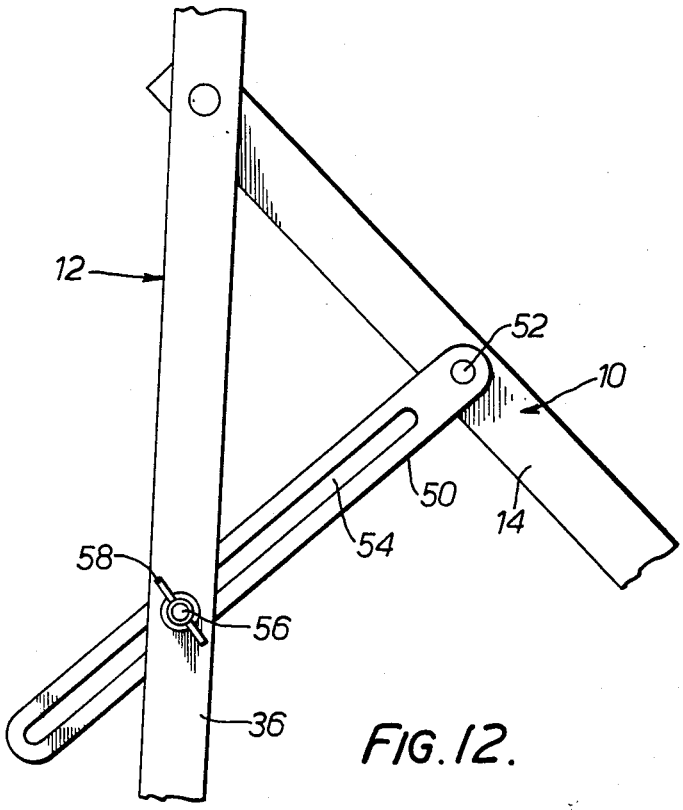
FIG. 12 is a view to an enlarged scale, corresponding to part of FIG. 2, of another modified exercising device.

FIG. 12 shows an arrangement in which the angle of the track system 10 to the horizontal in the operating position may be adjusted to different values. In this arrangement, the stop 44 is replaced by a slotted stay 50, which is pivoted at 52 to one of the tubes 14 of the track system 10, and whose slot 54 receives a bolt 56 which passes through the adjacent tube 36 of the support frame 12. By tightening a wing-nut 58 threaded on the bolt 56, the stay 50 can be gripped between the head of the bolt 56 and the tube 36, so that the track system 10 and the support frame 12 cannot splay further apart. Conversely, when the wing-nut 58 is slackened, the bolt 56 can slide in the slot 54, so that the frame 12 and the track system 10 can be pivoted in their storage position, or to a different operating position.

What I claim as my invention and desire to secure by Letters Patent is:

1. Exercising equipment comprising a pair of guide tracks, each said track having a pair of spaced parallel slideways, means for supporting the guide tracks in an inclined manner with one end higher than the other, a pair of foot-supporting members carried one on each of said tracks, each said foot-supporting member having a pair of slide portions supported on said slideways and a foot support portion between said slide portions, an elongate flexible tension-bearing element engaging each of said foot-supporting members, and guide means for said tension bearing element, said guide means including means for producing frictional resistance to movement of said foot-supporting members, said guide means comprising first and second guide members which are angularly fixed relative to said tracks near said one end and each having at least a partially cylindrical surface which is fixed against rotation relative to said tracks and said tension-bearing element, wherein said tension bearing element extends upwards along the track system from one foot-supporting member in a direction generally parallel to the direction of movement of the said one foot-supporting member to said first guide member, transversely of said tracks to said second guide member, and downwards along the track system to the other foot-supporting member in a direction generally parallel to the direction of movement of the said other foot-supporting member to provide reciprocating movement of said foot-supporting members, wherein said tension bearing element extends around said surfaces to be in frictional contact therewith, wherein tension in said tension bearing element produced by weight on said foot-supporting members causes said element to bear against said surfaces, and wherein the flexible tension bearing element is forced to slide frictionally around said surfaces when the foot-supporting members move along said track system such that energy is frictionally dissipated in said guide members and tension bearing element during exercise.

2. Exercising equipment as defined in claim 1, wherein the free ends of said tension bearing element are attached to said foot support members.

3. Exercising equipment comprising a track system, means for supporting said track system with one end higher than the other, a pair of foot-supporting members, first guide means for supporting said members on said track system for movement along said track system toward and away from said one end, an elongate flexible tension bearing element attached to each foot supporting member, and second guide means for supporting said tension bearing element, wherein said second guide means includes means for producing frictional resistance to movement of said foot supporting members comprising a pair of transversely spaced guide members fixed relative to said track system near said one end, each of said guide members having at least a partially cylindrical surface fixed against rotation relative to said track system and said tension bearing element, wherein said tension bearing element extends upwards from one foot-supporting member to one of said guide members, is deflected about the cylindrical surface of said one guide member to extend transversely of said track system to the other guide member, and is deflected about the cylindrical surface of said other guide member downwards to the other foot-supporting member and wherein said tension-bearing element is freely moveable, at least along the part of the element which extends from one foot-supporting member to the other in the longitudinal direction thereof.

4. Exercising equipment comprising a frame having a track assembly, a rear frame member, and means for pivotably connecting said track assembly and rear frame member for moving said track assembly and said rear frame member between a collapsed position to lie approximately in the same plane and an exercising position in which one end of said track assembly is supported by said rear frame member higher than the other such that said track assembly is at an inclined angle to ground, a pair of foot-supporting members, first guide means for supporting said foot supporting members on said track assembly for movement along said track assembly toward and away from said one end, an elongate flexible tension bearing element engaging each of said foot-supporting members, and second guide means for directing said element from one foot-supporting member toward said one end and for deflecting said element back toward said other foot supporting member to provide reciprocating movement of said foot-supporting members, wherein said second guide means includes means for producing frictional resistance to movement of said foot support members comprising at least one guide member with at least a partially cylindrical surface which is angularly stationary and fixed against rotation relative to said track system and said tension bearing element, and wherein said element engages said surface, tension in said tension bearing element, produced by weight on said foot-supporting members, causes said element to bear against said surface, and movement of said members along said track assembly causes said element to slide frictionally against said fixed surface such that energy is frictionally dissipated by said guide member and tension bearing element during exercise.

5. Exercising equipment as defined in claim 4, wherein each foot support member comprises a pair of spaced slideways adapted to slide in corresponding tracks in said track assembly, and wherein said slideways include means for pivotably supporting said foot supporting portion between said spaced slideways.

6. Exercising equipment as defined in claim 5, including pivot means for pivotally supporting said foot supporting portion at one end in said spaced slideways, and a slotted stay pivotally supported at one end in said slideways and having a longitudinal slot slidably receiving a support member mounted at the other end of the foot support portion, whereby said foot supporting portion is pivotally attached to one of said slideways for moving between a storage position, in which said stay and said foot supporting portion lie in the plane of said track system, and an exercising position in which the foot supporting portion is maintained in a generally horizontal position with respect to the ground by the foot of the user.

7. Exercising equipment as defined in claim 4, wherein each said foot-supporting member has a foot-support portion and means for pivotably supporting said foot-support portion for moving said foot-support portion between a collapsed position, lying substantially in the plane of said track assembly, and an exercising position, substantially horizontal to the ground.

8. Exercising equipment comprising a track system, means for supporting said track system with one end higher than the other, a pair of foot-support members, first guide means for supporting said members on said track system for movement along said track system toward and away from said one end, an elongate flexible tension-bearing element engaging each of said foot-supporting members, and second guide means for directing said element from one foot-supporting member towards said one end and for deflecting said element back towards said other foot-supporting member to provide reciprocating movement of said foot-supporting members, wherein said second guide means include means for producing frictional resistance to movement of said foot-support members comprising at least one guide member angularly fixed relative to said track system and having at least a partially cylindrical surface, about which said tension-bearing element extends, which is fixed against rotation relative to said track system and said tension-bearing element, wherein said element engages said surface, tension in said tension-bearing element, produced by weight on said foot-supporting members, causes said element to bear against said surface, and movement of said members along said track system causes said element to slide frictionally against said fixed surface such that energy is frictionally dissipated in said guide member and tension-bearing element during exercise.

* * * * *